US010155997B2

(12) United States Patent
Kamikawa et al.

(10) Patent No.: US 10,155,997 B2
(45) **Date of Patent: *Dec. 18, 2018**

(54) DEVICE FOR PRODUCING PARTIALLY REDUCED IRON

(71) Applicant: PRIMETALS TECHNOLOGIES JAPAN, LTD., Tokyo (JP)

(72) Inventors: Susumu Kamikawa, Hiroshima (JP); Hideaki Mizuki, Hiroshima (JP); Keiichi Sato, Hiroshima (JP); Hideki Itou, Hiroshima (JP); Khanhson Pham, Hiroshima (JP)

(73) Assignee: PRIMETALS TECHNOLOGIES JAPAN, LTD., Tokyo (JP)

( * ) Notice: Subject to any disclaimer, the term of this patent is extended or adjusted under 35 U.S.C. 154(b) by 251 days.

This patent is subject to a terminal disclaimer.

(21) Appl. No.: 15/103,386

(22) PCT Filed: Dec. 11, 2014

(86) PCT No.: PCT/JP2014/082802

§ 371 (c)(1),
(2) Date: Jun. 10, 2016

(87) PCT Pub. No.: WO2015/087959

PCT Pub. Date: Jun. 18, 2015

(65) Prior Publication Data

US 2016/0304977 A1 Oct. 20, 2016

(30) Foreign Application Priority Data

Dec. 11, 2013 (JP) ..... 2013-255779

(51) Int. Cl.
*C21B 13/00* (2006.01)
*C21B 13/10* (2006.01)
(Continued)

(52) U.S. Cl.
CPC ..... *C21B 13/004* (2013.01); *C21B 7/002* (2013.01); *C21B 11/08* (2013.01);
(Continued)

(58) Field of Classification Search
CPC ..... F27M 2003/165; F27D 21/00; C22B 1/16; C21B 11/08; C21B 13/004; C21B 13/0046; C21B 13/10; C21B 7/002
(Continued)

(56) References Cited

U.S. PATENT DOCUMENTS 8,038,766 B2 * 10/2011 Orth ..... C21B 13/002 423/138
8,961,650 B2 * 2/2015 Kamikawa ..... C21B 11/10 266/156
(Continued)

FOREIGN PATENT DOCUMENTS

CN 103131850 A 6/2013
JP 11-248359 A 9/1999
(Continued)

*Primary Examiner* — Scott R Kastler
*Assistant Examiner* — Michael Aboagye
(74) *Attorney, Agent, or Firm* — Birch, Stewart, Kolasch & Birch, LLP

(57) ABSTRACT

Provided is a device for producing partially reduced iron, with which partially reduced iron having a prescribed reduction ratio can be produced efficiently. The present invention is equipped with: CO sensors that detect the carbon monoxide concentration in an exhaust gas; an $O_2$ sensor that detects the oxygen concentration in an exhaust gas; an exhaust gas circulation device that adjusts the circulating amount of the exhaust gas supplied to a reduction furnace main body, and an air feed device that adjusts the amount of air that being fed; and a control device that controls these devices. The control devices on the basis of the carbon monoxide concentration in the exhaust gas as detected by the CO sensor and the oxygen concentration in the exhaust gas as detected by the $O_2$ sensor.

11 Claims, 3 Drawing Sheets

(51) Int. Cl.

| | |
|---|---|
| ***F27D 21/00*** | (2006.01) |
| ***C21B 7/00*** | (2006.01) |
| ***C22B 1/16*** | (2006.01) |
| ***C21B 11/08*** | (2006.01) |
| *F27D 19/00* | (2006.01) |

(52) U.S. Cl.
CPC ..... *C21B 13/0046* (2013.01); *C21B 13/10* (2013.01); *C22B 1/16* (2013.01); *F27D 21/00* (2013.01); *C21B 2100/04* (2013.01); *C21B 2100/60* (2017.05); *C21B 2100/64* (2017.05); *F27D 2019/0015* (2013.01); *F27D 2019/0031* (2013.01); *F27M 2003/165* (2013.01)

(58) Field of Classification Search
USPC ..... 266/193, 178, 197, 156, 144, 79, 171, 266/176, 155; 75/772, 746, 504, 756, 75/484, 433, 421
See application file for complete search history.

(56) References Cited

U.S. PATENT DOCUMENTS

| | | | | |
|---|---|---|---|---|
| 8,974,571 | B2 * | 3/2015 | Kamikawa | C21B 11/00 266/156 |
| 9,163,879 | B2 * | 10/2015 | Kamikawa | F27D 17/008 |
| 2013/0139647 | A1 * | 6/2013 | Kamikawa | C21B 11/10 75/10.63 |

FOREIGN PATENT DOCUMENTS

| | | | |
|---|---|---|---|
| JP | 2001-115204 | A | 4/2001 |
| JP | 2002-97508 | A | 4/2002 |
| JP | 2003-183716 | A | 7/2003 |
| JP | 2004-169140 | A | 6/2004 |
| JP | 2013-117050 | A | 6/2013 |

* cited by examiner

DEVICE FOR PRODUCING PARTIALLY REDUCED IRON

TECHNICAL FIELD

The present invention relates to a device for producing partially reduced iron which produces partially reduced iron by reducing agglomerates containing iron oxide.

BACKGROUND ART

For example, Patent Document 1 listed below discloses the following technique as a conventional technique for producing partially reduced iron by reducing agglomerates containing iron oxide. Agglomerate-like reduced iron is stacked on a grate of a horizontally-circulating grate reduction furnace, pellets are stacked on the reduced iron and are ignited, and pellets are further stacked after the ignition. Meanwhile, an oxygen-containing gas is made to flow from below to above the agglomerate-like reduced iron and the oxygen concentration of the oxygen-containing gas is reduced stepwise along with the movement of the pellets to the downstream side. The pellets are thereby reduced sequentially from a lower layer to an upper layer of the pellet bed and the partially reduced iron is produced.

Moreover, Patent Document 2 listed below discloses the following technique. Pellets (raw material) formed by mixing and pelletizing powders of iron ore, coal, limestone, and the like are supplied to the reduction furnace and are exposed to a high-temperature atmosphere. Meanwhile, the oxygen concentration of a gas to be supplied into the furnace is adjusted based on a detected temperature inside the furnace to control the temperature inside the furnace. The pellets are thereby reduced and the partially reduced iron is produced.

PRIOR ART DOCUMENT

Patent Document

Patent Document 1: Japanese Patent Application Publication No. 2002-97508

Patent Document 2: Japanese Patent Application Publication No. 2001-115204

SUMMARY OF THE INVENTION

Problems to be Solved by the Invention

In the technique described in the aforementioned Patent Document 1, desired partially reduced iron can be obtained from given pellets by maintaining the oxygen concentration of the atmosphere inside the furnace to a constant estimated level. However, since the oxygen concentration of the oxygen-containing gas is not controlled according to a combustion state of the pellet bed, insufficient reduction or excessive fusing occurs when the pellets vary greatly in the particle size distribution, the water content amount, the composition, and the like or the variation among lots of the pellets is great, and this may reduce the yield of the partially reduced iron. Meanwhile, directly measuring the temperature of a portion where the reduction is occurring in the pellet bed is conceivable. However, since the temperature measuring portion moves downstream together with the grate and a combustion zone in the pellet bed moves upward in the stacking direction along with the movement, it is difficult to directly measure the temperature of the pellets in the reduction region.

The technique described in the aforementioned Patent Document 2 has the following problem. Although one or two layers of pellets supplied into the furnace can be heated by radiation heating of an atmosphere gas in the furnace, all of the pellets in the stacking direction cannot be heated when the stacking height of the pellets is great. The productivity of the partially reduced iron is thus extremely low.

In other words, the conventional techniques have a problem that, in the heating of pellets in the deep bed which can improve productivity of the partially reduced iron, there is no method of practically and continuously grasping the reduction state (combustion state) in the entire region of the pellets in the stacking direction and thus it is difficult to recognize insufficient reduction, excessive fusing, or the like occurring in the middle of the reduction.

The present invention has been thus made to solve the problems described above, and an object is to provide a device for producing partially reduced iron capable of efficiently producing partially reduced iron with a predetermined degree of reduction.

Means for Solving the Problems

A device for producing partially reduced iron of the present invention which solves the problems described above is a device for producing partially reduced iron including: a reduction furnace main body in which pellets formed by mixing and pelletizing a reduction carbon material and an iron oxide-containing raw material are packed on an endless grate to be heated and reduced; exhaust gas circulating means for circulating an exhaust gas discharged from the pellet bed by discharging the exhaust gas from the reduction furnace main body and feeding the exhaust gas to the reduction furnace main body; and air feeding means for feeding air to the reduction furnace main body, the device being configured to produce a partially reduced iron by combusting a flammable gas and a volatile component together with the exhaust gas and the air to form a combustion zone in the pellet bed, and causing the combustion zone to move sequentially toward an upper side of the pellet bed along with the movement of the endless grate, the flammable gas generated by the reduction, the volatile component generated when the pellets which are heated heat the pellets in an upper layer, characterized in that the device for producing partially reduced iron comprises: carbon monoxide concentration detecting means for detecting a carbon monoxide concentration of the exhaust gas discharged from the reduction furnace main body; oxygen concentration detecting means for detecting an oxygen concentration of the exhaust gas to be fed to the reduction furnace main body; exhaust gas circulation rate adjusting means for adjusting a circulation rate of the exhaust gas to be fed to the reduction furnace main body by the exhaust gas circulating means; air feed rate adjusting means for adjusting a feed rate of the air to be fed to the reduction furnace main body by the air feeding means; and control means for controlling the exhaust gas circulation rate adjusting means and the air feed rate adjusting means, the control means controls the exhaust gas circulation rate adjusting means and the air feed rate adjusting means based on the carbon monoxide concentration of the exhaust gas detected by the carbon monoxide concentration detecting means and the oxygen concentration of the exhaust gas detected by the oxygen concentration detecting means.

A device for producing partially reduced iron of the present invention which solves the problems described above is the aforementioned device for producing partially reduced iron of the present invention characterized in that the reduction furnace main body includes a reduction region in which the combustion zone is formed in the pellet bed and moves sequentially toward the upper side of the pellet bed along with the movement of the endless grate, the carbon monoxide concentration detecting means detects a carbon monoxide concentration of the exhaust gas discharged from the reduction region of the reduction furnace main body, the exhaust gas circulation rate adjusting means adjusts a circulation rate of the exhaust gas to be fed to the reduction region of the reduction furnace main body, and the air feed rate adjusting means adjusts a feed rate of the air to be fed to the reduction region of the reduction furnace main body.

A device for producing partially reduced iron of the present invention which solves the problems described above is the aforementioned device for producing partially reduced iron of the present invention characterized in that the reduction furnace main body includes an ignition region in which a lower layer of the pellet bed is ignited by the pellets which are ignited, the carbon monoxide concentration detecting means detects a carbon monoxide concentration of the exhaust gas discharged from the ignition region of the reduction furnace main body, the exhaust gas circulation rate adjusting means adjusts a circulation rate of the exhaust gas to be fed to the ignition region of the reduction furnace main body, and the air feed rate adjusting means adjusts a feed rate of the air to be fed to the ignition region of the reduction furnace main body.

A device for producing partially reduced iron of the present invention which solves the problems described above is the aforementioned device for producing partially reduced iron of the present invention characterized in that when the carbon monoxide concentration of the exhaust gas detected by the carbon monoxide concentration detecting means is lower than a carbon monoxide concentration lower limit value, the control means controls the exhaust gas circulation rate adjusting means and the air feed rate adjusting means and also controls the exhaust gas circulating means and the air feeding means such that a total oxygen concentration of the exhaust gas and the air to be fed to the reduction furnace main body is increased and a flow rate of the exhaust gas and the air to be fed to the reduction furnace main body is constant, and when the carbon monoxide concentration of the exhaust gas detected by the carbon monoxide concentration detecting means is higher than a carbon monoxide concentration upper limit value, the control means controls the exhaust gas circulation rate adjusting means and the air feed rate adjusting means and also controls the exhaust gas circulating means and the air feeding means such that the total oxygen concentration of the exhaust gas and the air to be fed to the reduction furnace main body is decreased and the flow rate of the exhaust gas and the air to be fed to the reduction furnace main body is constant.

A device for producing partially reduced iron of the present invention which solves the problems described above is the aforementioned device for producing partially reduced iron of the present invention characterized in that the reduction furnace main body includes a hood and a plurality of wind boxes which cover the endless grate from above and below, the exhaust gas circulating means discharges the exhaust gas from each of portions of the hood facing the plurality of wind boxes and feeds the exhaust gas to each of the plurality of wind boxes, the air feeding means feeds the air to each of the plurality of wind boxes, the carbon monoxide detecting means detects a carbon monoxide concentration of the exhaust gas discharged from each of the portions of the hood facing the plurality of wind boxes, and the control means controls the exhaust gas circulation rate adjusting means and the air feed rate adjusting means for each of the plurality of wind boxes, based on the carbon monoxide concentration of the exhaust gas detected by the carbon monoxide detecting means and the oxygen concentration of the exhaust gas detected by the oxygen concentration detecting means.

Effect of the Invention

According to the present invention, since the carbon monoxide concentration in the exhaust gas discharged from the reduction furnace main body is detected, the reduction state of the pellets which correlates with the carbon monoxide concentration in the exhaust gas can be surely estimated, even when the pellets vary greatly in the particle size distribution, the water content amount, the composition, and the like and the variation among lots of the pellets is great. Since the carbon monoxide concentration in the exhaust gas, i.e. the total oxygen concentration of the exhaust gas and the air to be fed to the reduction furnace main body is adjusted based on the estimation, the temperature of the combustion zone in the pellet bed can be stabilized. Accordingly, partially reduced iron with a predetermined degree of reduction can be efficiently produced without insufficient reduction or excessive fusing.

MODE FOR CARRYING OUT THE INVENTION

An embodiment of a device for producing partially reduced iron in the present invention is described below with reference to the drawings.

Figure 1:
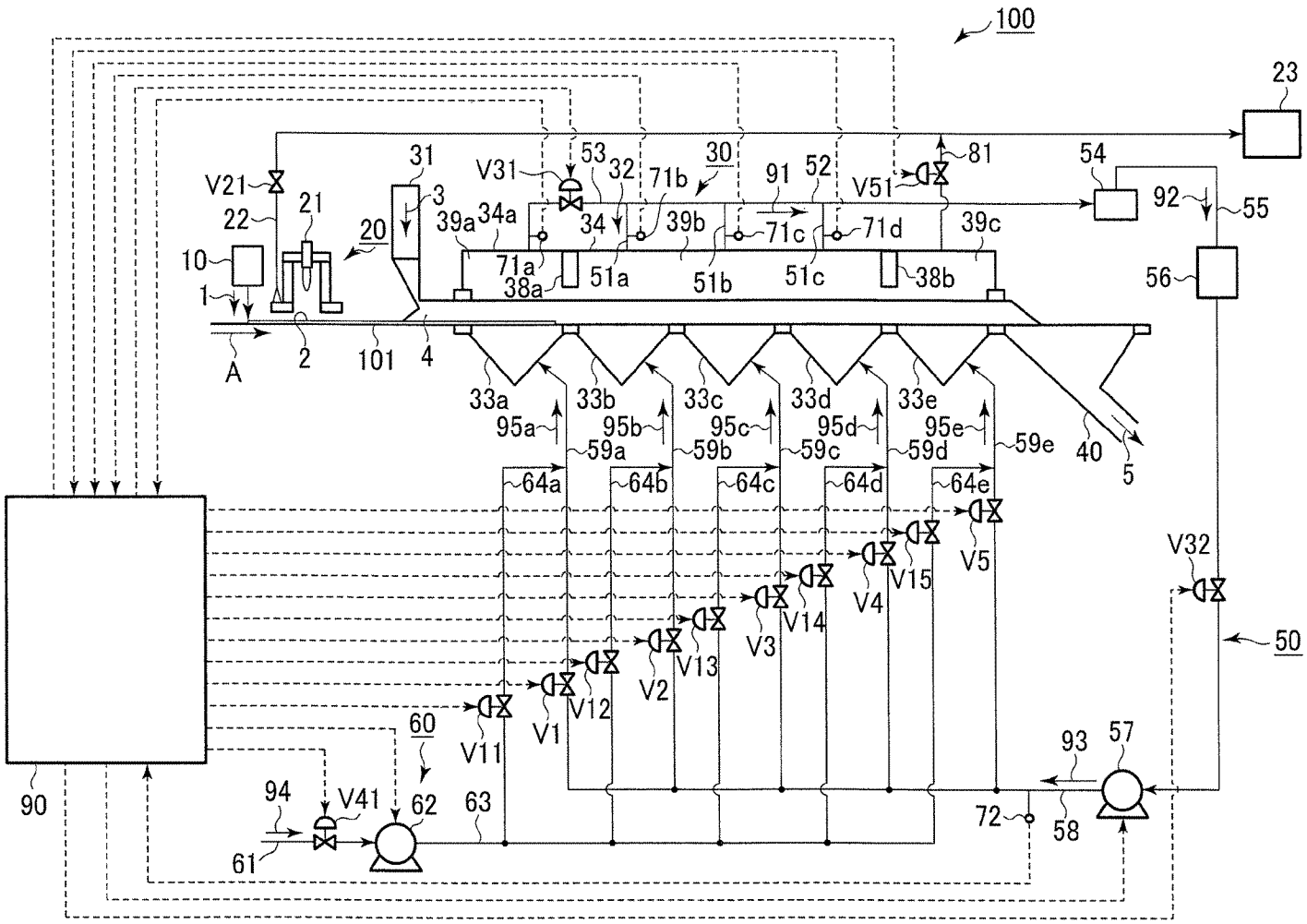
FIG. 1 is a schematic view of a device for producing partially reduced iron in an embodiment of the present invention.
Figure 2A:
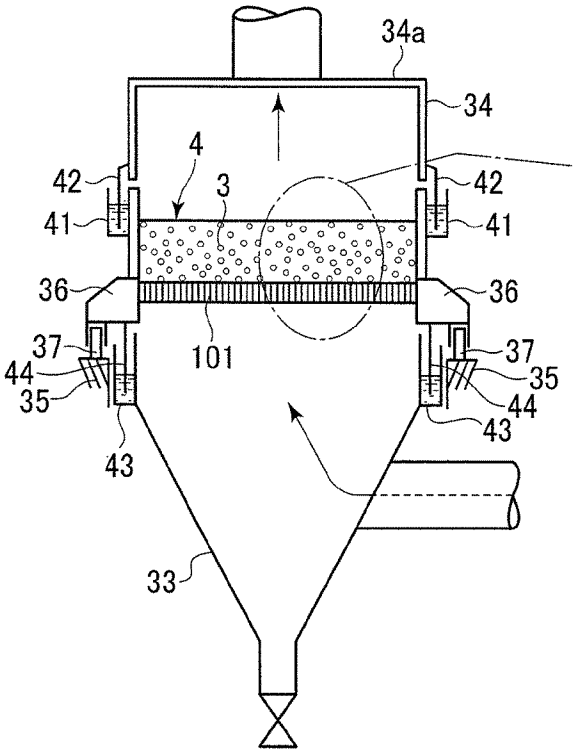
FIG. 2 is an explanatory view of the device for producing partially reduced iron in the embodiment of the present invention, part (a) of FIG. 2 shows a cross section of a reduction furnace included in the device for producing partially reduced iron, and part (b) of FIG. 2 shows a relationship between an oxygen concentration and a raw-material pellet bed height in the reduction furnace.
Figure 2B:
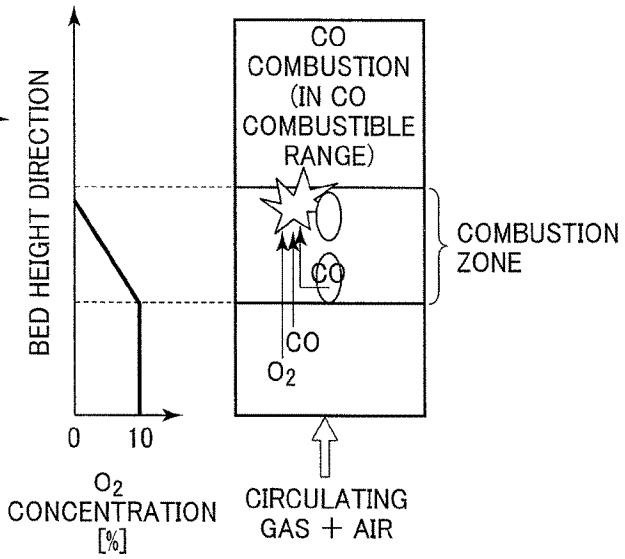
Figure 3:
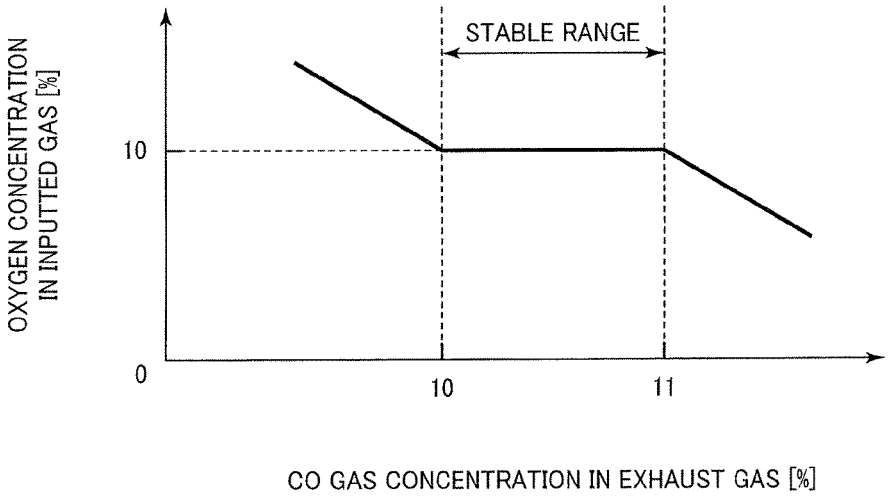
FIG. 3 is a graph showing a relationship between a carbon monoxide concentration in an exhaust gas and an oxygen concentration in a mixed gas when the temperature of a combustion zone is maintained at 1300° C. in a raw-material pellet bed.

The device for producing partially reduced iron in the embodiment is described based on FIGS. 1 to 3. Note that, in FIG. 1, the arrow A indicates a traveling direction of a grate.

As shown in FIG. 1 and parts (a) and (b) of FIG. 2, the device for producing partially reduced iron in the embodiment includes a downward-pressing type grate reduction furnace 100. The grate reduction furnace 100 has an annular shape as a whole. The grate reduction furnace 100 includes an ignition raw-material pellet supplying device 10, a heating furnace 20, and a reduction furnace (partial reduction furnace) 30. These device and furnaces are arranged in the order of description from upstream in the traveling direction of the grate (endless grate) 101.

The ignition raw-material pellet supplying device 10 is a device which supplies ignition raw-material pellets 1 onto the grate 101 and adjusts the height of an ignition raw-material pellet layer 2, which is formed by stacking the ignition raw-material pellets 1, to a predetermined level. In other words, the ignition raw-material pellet supplying device 10 forms ignition raw-material pellet supplying means. The ignition raw-material pellets 1 are made of the same material as that of raw-material pellets 3 to be described later in detail and form part of the raw-material pellets 3. The stacking height of the ignition raw-material pellets 1 is such a height that the after-mentioned raw-material pellets 3 packed on the ignition raw-material pellet layer 2 can be ignited, and is, for example, greater than 5 mm and less than 20 mm, preferably greater than 5 mm and 10 mm or less. When the stacking height of the ignition raw-material pellet layer 2 is 5 mm or less, the amount of heat generated by combustion of the ignited ignition raw-material pellets 1 is so small that a flammable volatile component cannot be generated from a reduction carbon material in the raw-material pellets 3 due to an insufficient amount of heat. Meanwhile, when the stacking height is 20 mm or greater, the pellets in a lowermost layer of the raw-material pellet bed 4 formed by packing the raw-material pellets 3 are poorly heated and some of the raw-material pellets 3 are not reduced, thereby becoming unreduced pellets.

The heating furnace 20 includes a combustion burner 21 which heats the ignition raw-material pellet layer 2 (ignition raw-material pellets 1) supplied onto the grate 101 to a reduction temperature range. In other words, the heating furnace 20 forms heating means whose interior temperature can be controlled. The heating furnace 20 has such a length that the heated ignition raw-material pellet layer 2 can be heated at a high temperature for a predetermined time. The heating furnace 20 also includes a combustion gas exhaust duct 22. The combustion gas exhaust duct 22 is provided with a flow-rate adjusting valve V21. A front end opening portion of the combustion gas exhaust duct 22 is disposed upstream of the combustion burner 21 in the traveling direction of the grate 101. A rear end portion side of the combustion gas exhaust duct is connected to a dust collector 23. Accordingly, a combustion gas generated when the ignition raw-material pellet layer 2 is heated by the combustion burner 21 is discharged to the outside of a system through the combustion gas exhaust duct 22 and the dust collector 23.

The reduction furnace 30 is a device which produces an agglomerate-like partially reduced iron 5 by reducing the raw-material pellets 3. The reduction furnace 30 includes a raw-material pellet supplying device 31, a reduction furnace main body 32, and a partially reduced iron discharging device 40 which are arranged in this order from upstream in the traveling direction of the grate 101. The raw-material pellet supplying device (feed hopper) 31 is a device which supplies the raw-material pellets 3 onto the ignition raw-material pellet layer 2. The raw-material pellet supplying device 31 supplies the raw-material pellets 3 onto the ignition raw-material pellet layer 2 and adjusts the height of the raw-material pellet bed 4, which is formed by packing the raw-material pellets 3, to a predetermined level. In other words, the raw-material pellet supplying device 31 forms raw-material pellet supplying means. The raw-material pellets 3 are a raw material of the partially reduced iron to be eventually produced and are formed by mixing and pelletizing an iron oxide-containing raw material, the reduction carbon material, and a lime-based slag-forming flux and then coating the resultant object with an anti-oxidant. For example, the raw-material pellets 3 each contain coal by about 20% of its total amount and the amount of the flammable volatile component in the coal is 20% or more.

The reduction furnace main body 32 described above includes a wind box 33 which is a fixed structure installed below the grate 101, an annular hood 34 which is a fixed structure installed above the wind box 33 with the grate 101 therebetween, and tracks 35, 35 which are laid in an annular shape on both sides of the wind box 33.

The aforementioned wind box 33 includes multiple wind boxes in accordance with the diameter of the grate, such as a first wind box 33*a*, a second wind box 33*b*, a third wind box 33*c*, a fourth wind box 33*d*, and a fifth wind box 33*e* which are arranged in this order from the raw-material pellet supplying device 31 side in the traveling direction A of the grate 101.

Two partition plates 38*a*, 38*b* are provided on a ceiling plate 34*a* of the aforementioned hood 34, and a space between the grate 101 and the hood 34 are partitioned into three regions 39*a*, 39*b*, 39*c* in the traveling direction A of the grate 101. The first partition plate 38*a* is disposed at such a position as to define a space above the first wind box 33*a* and a space above the second wind box 33*b*. The second partition plate 38*b* is disposed at such a position as to define a space above the fourth wind box 33*d* and a space above the fifth wind box 33*e*. A region surrounded by the grate 101, the hood 34, and the first partition plate 38*a* thereby forms the ignition region (ignition raw-material pellet combustion region) 39*a* to be described in detail later. A region surrounded by the grate 101, the hood 34, and the first and second partition plates 38*a*, 38*b* forms the reduction region (raw-material pellet heating region) 39*b*. A region surrounded by the grate 101, the hood 34, and the second partition plate 38*b* forms the cooling region 39*c*.

The grate 101 is porous and is configured such that a gaseous body can pass therethrough in a vertical direction but the ignition raw-material pellets 1 and the raw-material pellets 3 cannot. The grate 101 is divided into multiple units and the annular grate 101 is formed by arranging these units in a circumferential direction. Each of the divided units is tiltably attached to annular supporting frames 36, 36 provided respectively on both sides of the grate 101. The supporting frames 36, 36 are provided with rollers 37, 37 configured to travel on the tracks 35, 35. Causing the rollers 37, 37 to travel on the tracks 35, 35 allows the grate 101 to horizontally circulate in a space between the wind box 33 and the hood 34.

Water seal troughs 41, 41 filled with water are annularly provided in upper portions of the supporting frames 36, 36 of the grate 101, along the entire peripheries thereof. Seal plates 42, 42 extending downward are annularly provided in lower portions of the hood 34 on both sides, along the entire peripheries thereof. Lower end portions of the seal plates 42, 42 are submerged in a liquid in the water seal troughs 41, 41. Hence, spaces between the supporting frames 36, 36 of the grate 101 and the lower portions of the hood 34 on both sides are sealed in an air-tight manner. In other words, the water seal troughs 41 and the seal plates 42 form a water seal device above the grate.

Meanwhile, water seal troughs 43, 43 filled with water are annularly provided in upper portions of the wind box 33 on both sides, along the entire peripheries thereof. Seal plates 44, 44 extending downward are annularly provided in lower portions of the supporting frames 36, 36 of the grate 101, along the entire peripheries thereof. Lower end portions of the seal plates 44, 44 are submerged in a liquid in the water seal troughs 43, 43. Hence, spaces between the supporting frames 36, 36 of the grate 101 and the upper portions of the wind box 33 on both sides are sealed in an air-tight manner. In other words, the water seal troughs 43 and the seal plates 44 form a water seal device below the grate.

One end portion (base end portion) of a cooling region gas exhaust duct 81 is connected to a portion of the ceiling plate 34*a* of the hood 34 which is located in the cooling region 39*c*. The other end portion (front end portion) of the cooling region gas exhaust duct 81 is connected to the aforementioned combustion gas exhaust duct 22. A flow-rate adjusting valve V51 is provided in the cooling region gas exhaust duct 81 and a discharge rate of the exhaust gas in the cooling region 39*c* can be thereby adjusted.

The aforementioned reduction furnace 30 further includes an exhaust gas circulating device (exhaust gas circulating means) 50. The exhaust gas circulating device 50 includes first to third exhaust ducts 51*a* to 51*c*, an exhaust manifold 52, an ignition region gas exhaust duct 53, a scrubber 54, an exhaust gas duct 55, a mist separator 56, a blower 57, a circulating gas duct 58, and first to fifth branch circulating gas ducts 59*a* to 59*e*.

One end portions (base end sides) of the first to third exhaust ducts 51*a* to 51*c* are connected to a portion of the ceiling plate 34*a* of the hood 34 which is located in the reduction region 39*b* facing the second to fourth wind boxes 33*b* to 33*d* with the grate 101 therebetween, while the other end portions (front end sides) of the first to third exhaust ducts 51*a* to 51*c* are connected to the exhaust manifold 52 connected to the scrubber 54. Moreover, one end portion (base end side) of the exhaust manifold 52 is connected to the ignition region gas exhaust duct 53 connected to a portion of the ceiling plate 34*a* of the hood 34 which is located in the ignition region 39*a* facing the first wind box 33*a* with the grate 101 therebetween. A flow-rate adjusting valve V31 is provided in the ignition region gas exhaust duct 53 and a discharge rate of the exhaust gas in the ignition region 39*a* can be adjusted. An exhaust gas 91 in the ignition region 39*a* and the reduction region 39*b* is thus delivered to the scrubber 54 through the ignition region gas exhaust duct 53, the first to third exhaust ducts 51*a* to 51*c*, and the exhaust manifold 52, and is subjected to removal of solid objects such as dust in the exhaust gas 91 in the scrubber 54.

The scrubber 54 is connected to one end portion (base end portion) of the exhaust gas duct 55. The other end portion of the (front end portion) of the exhaust gas duct 55 is connected to a gas receiving port of the blower 57. The mist separator 56 and a flow-rate adjusting valve V32 are provided in the exhaust gas duct 55. A gas delivery port of the blower 57 is connected to a base end side of the circulating gas duct 58. The circulating gas duct 58 is connected to base end sides of the first to fifth branch circulating gas ducts 59*a* to 59*e*. Front end sides of the first to fifth branch circulating gas ducts 59*a* to 59*e* are connected to the first to fifth wind boxes 33*a* to 33*e*, respectively. Flow-rate adjusting valves V1 to V5 are provided respectively in the first to fifth branch circulating gas ducts 59*a* to 59*e*. An exhaust gas (dust-removed gas) 92 from which dust is removed is thus subjected to mist removal in the mist separator 56 and turns into an exhaust gas 93, and the flow-rate of the exhaust gas 93 is adjusted by the flow-rate adjusting valves V32, V1 to V5. In other words, the exhaust gas 91 turns into the exhaust gas 93 and is reused in the reduction furnace 30 as the circulating gas.

The aforementioned reduction furnace 30 further includes an air feeding device (air feeding means) 60. The air feeding device 60 includes an air feed duct 61, a blower 62, an air duct 63, and first to fifth branch air ducts 64*a* to 64*e*. One end portion (base end portion) of the air feed duct 61 is open to the atmosphere. The other end portion (front end portion) of the air feed duct 61 is connected to a gas receiving port of the blower 62. A gas delivery port of the blower 62 is connected to one end portion (base end portion) of the air duct 63. The air duct 63 is connected to base end sides of the first to fifth branch air ducts 64*a* to 64*e*. Front end sides of the first to fifth branch air ducts 64*a* to 64*e* are connected to the first to fifth branch circulating gas ducts 59*a* to 59*e*, respectively. Flow-rate adjusting valves V41, V11 to V15 configured to adjust the flow rate of air 94 are provided in the air feed duct 61 and the first to fifth branch air ducts 64*a* to 64*e*, respectively. Mixed gases (oxygen containing gases) 95*a* to 95*e* obtained by mixing the exhaust gas 93 and the air 94 at predetermined ratios by adjusting the flow-rate adjusting valves V1 to V5, V11 to V15, V31, V32, V41 can be fed to the wind boxes 33*a* to 33*e*, respectively.

CO sensors (carbon monoxide concentration detecting means) 71*a* to 71*d* configured to detect carbon monoxide concentrations are provided in the ignition region gas exhaust duct 53 and the first to third exhaust ducts 51*a* to 51*c*, respectively. An $O_2$ sensor (oxygen concentration detecting means) 72 configured to detect an oxygen concentration is provided on the base end side of the circulating gas duct 58.

The aforementioned reduction furnace 30 further includes a control device (control means) 90 which is connected to output sides of the CO sensors 71*a* to 71*d* and the $O_2$ sensor 72 and which is also connected to input sides of the flow-rate adjusting valves V1 to V5, V11 to V15, V31, V32, V41, V51 and the blowers 57, 62. The control device 90 is also connected to an input side of the flow-rate adjusting valve V21.

The control device 90 controls opening degrees of the flow-rate adjusting valves V1 to V5, V11 to V15, V31, V32, V41 and operations of the blowers 57, 62, based on the carbon monoxide concentrations detected by the CO sensors 71*a* to 71*d* and the oxygen concentration detected by the $O_2$ sensor 72, such that each of the oxygen concentrations of the mixed gases 95*a* to 95*e* fed to the wind boxes 33*a* to 33*e* is adjusted to a predetermined concentration. The mixed gases 95*a* to 95*e* whose oxygen concentrations are adjusted respectively for the wind boxes 33*a* to 33*e* can be thereby fed into the furnace above the grate 101. Hence, the oxygen concentrations can be adjusted such that a desired temperature distribution is obtained in the height direction of the raw-material pellet bed 4. Moreover, in each of the ignition region 39*a*, the reduction region 39*b*, and the cooling region 39*c*, since oxygen in the atmosphere inside the furnace can be adjusted to a desired concentration, the oxygen concentration can be adjusted such that a desired temperature distribution is obtained in the height direction of the raw-material pellet bed 4.

The partially reduced iron discharging device 40 is a device which discharges, from the grate 101, the partially reduced iron 5 produced while passing through the regions 39*a* to 39*c* described above.

In the embodiment as described above, the flow-rate adjusting valves V1 to V5, V31, V32 and the like form exhaust gas circulation rate adjusting means. The flow-rate adjusting valves V11 to V15, V41 and the like form air feed rate adjusting means.

Description is given of a method of producing partially reduced iron by using the device for producing partially reduced iron of the embodiment configured as described above.

First, the ignition raw-material pellet supplying device 10 supplies the ignition raw-material pellets 1 onto the grate 101, and forms the ignition raw-material pellet layer 2 whose height is, for example, 5 mm to 20 mm. The ignition raw-material pellet layer 2 moves to a position below the combustion burner 21 of the heating furnace 20 along with the movement of the grate 101. The combustion burner 21 heats the ignition raw-material pellet layer 2 to the reduction temperature range which is, for example, about 1200° C. The ignition raw-material pellet layer 2 heated to the reduction temperature range moves to a position below the raw-material pellet supplying device 31 along with the movement of the grate 101. The raw-material pellet supplying device 31 supplies the raw-material pellets 3 onto the ignition raw-material pellet layer 2 to form the raw-material pellet bed 4 whose height is, for example, about 200 mm.

Next, the ignition raw-material pellet layer 2 and the raw-material pellet bed 4 move into the reduction furnace 30 along with the movement of the grate 101. In the reduction furnace 30, the mixed gases 95*a* to 95*e* obtained by mixing the exhaust gas (circulating gas) 93 and the air 94 are made to flow from the wind boxes 33*a* to 33*e* below the ignition raw-material pellet layer 2 and the raw-material pellet bed 4 toward the ceiling plate 34*a* of the hood 34 above the layers 2 and 4.

The oxygen concentration of the mixed gas 95*a* to be fed into the first wind box 33*a* is adjusted to, for example, 15% by the flow-rate adjusting valves V1, V11, and the mixed gas 95*a* having the oxygen concentration of 15% is made to flow from below to above the ignition raw-material pellet layer 2 and the raw-material pellet bed 4. In the ignition region 39*a* above the first wind box 33*a*, the heated ignition raw-material pellets 1 heat the raw-material pellets 3 adjacent to the heated ignition raw-material pellets 1, and the flammable volatile component is generated from the heated raw-material pellets 3 and is combusted. The heat of this combustion heats the raw-material pellet bed 4 above the ignition raw-material pellet layer 2.

The oxygen concentrations of the mixed gases 95*b* to 95*d* to be fed to the second to fourth wind boxes 33*b* to 33*d* are adjusted to, for example, 11% by the flow-rate adjusting valves V2 to V4, V12 to V14, and the mixed gases 95*b* to 95*d* having the oxygen concentration of 11% are made to flow from below to above the raw-material pellet bed 4 heated by the ignition raw-material pellet layer 2. In the reduction region 39*b* above the second to fourth wind boxes 33*b* to 33*d*, the flammable volatile component is generated from the reduced coal material in the raw-material pellets 3 in the raw-material pellet bed 4 heated by the ignition raw-material pellet layer 2, and about 75% to 90% of the flammable volatile component is combusted. The temperature of the raw-material pellets 3 further rises due to the combustion of the flammable volatile component and the reduction reaction proceeds. A carbon monoxide gas is thereby generated and part of the generated carbon monoxide gas is combusted. As a result, high concentration of carbon monoxide which is about, for example, 8% is generated in a center portion of the inside of the hood 34 in the grate traveling direction. Meanwhile, the raw-material pellets 3 adjacent to the raw-material pellets 3 whose temperature has risen are heated and the flammable volatile component is generated from the reduction carbon material in the adjacent raw-material pellets 3. The exhaust gas 91 containing the remainder of the flammable volatile component and the carbon monoxide gas flows through the first to third exhaust ducts 51*a* to 51*c* and the exhaust manifold 52 to be introduced into the scrubber 54. In the scrubber 54, the exhaust gas 91 turns into the exhaust gas 92 from which solid objects are removed. The exhaust gas 92 flows through the exhaust gas duct 55, is subjected to mist removal in the mist separator 56, and turns into the exhaust gas 93. The exhaust gas 93 further flows through the exhaust gas duct 55, flows through the blower 57, the circulating gas duct 58, and the second to fourth branch circulating gas ducts 59*b* to 59*d*, is mixed with the air 94 flowing through the air feed duct 61, the blower 62, the air duct 63, and the second to fourth branch air ducts 64*b* to 64*d* to turn into the mixed gases 95*b* to 95*d*. The mixed gases 95*b* to 95*d* are fed to the raw-material pellets 3 whose temperature has further risen, through the second to fourth wind boxes 33*b* to 33*d* and the grate 101. A combustion zone in which the raw-material pellets 3 are combusted thereby moves from a lower layer to an upper layer of the raw-material pellet bed 4.

The oxygen concentration of the mixed gas 95*e* to be fed to the fifth wind box 33*e* is adjusted to, for example, 5% or lower by the flow-rate adjusting valves V5, V15, and the mixed gas 95*e* having the oxygen concentration of 5% or less is made to flow from below to above the raw-material pellet bed 4 whose reduction has progressed to a predetermined degree. In the cooling region 39*c* above the fifth wind box 33*e*, the raw-material pellet bed 4 whose reduction has progressed to the predetermined degree is cooled to about 100° C. to about 800° C., and turns into the desired partially reduced iron 5.

Then, the desired partially reduced iron 5 moves onto the partially reduced iron discharging device 40 along with the movement of the grate 101 and is discharged from the inside of the reduction furnace 30.

In the aforementioned device for producing partially reduced iron of the embodiment, the control device 90 estimates the reduction state (combustion state) of the ignition raw-material pellet layer 2 and the raw-material pellet bed 4 in the reduction furnace 30 from the carbon monoxide concentration of the exhaust gas 91, and controls the opening degrees of the flow-rate adjusting valves V1 to V5, V11, V15, V31, V32, V41 and the operations of the blowers 57, 62, based on the estimation result and the oxygen concentration of the exhaust gas 93, such that the oxygen concentrations of the mixed gas 95*a* to be fed to the heating region 39*a*, the mixed gases 95*b* to 95*d* to be fed to the reduction region 39*b*, and the mixed gas 95*e* to be fed the cooling region 39*c* in the reduction furnace 30 are adjusted to the predetermined values, more specifically, such that the oxygen concentrations of the mixed gases 95*a* to 95*e* to be fed respectively to the wind boxes 33*a* to 33*e* are adjusted to the predetermined values.

The control device 90 estimates the combustion state of the ignition raw-material pellet layer 2 in the ignition region 39*a* from the carbon monoxide concentration of the exhaust gas 91 flowing through the ignition region gas exhaust duct 53 which is detected by the CO sensor 71*a*.

When the carbon monoxide concentration of the exhaust gas 91 is lower than a carbon monoxide concentration lower limit value (for example, 10%), the control device 90 estimates that the temperature of the ignition raw-material pellet layer 2 is lower than 1300° C. The control device 90 then controls the opening degrees of the flow-rate adjusting valves V1, V11, based on the oxygen concentration of the exhaust gas 93 detected by the $O_2$ sensor 72, such that the oxygen concentration of the mixed gas 95*a* exceeds a predetermined oxygen concentration value (oxygen concentration required to stably combust the ignition raw-material pellet layer 2 at 1300° C.), and also controls the operations of the blowers 57, 62 such that the flow rate of the mixed gas 95*a* is constant.

When the carbon monoxide concentration of the exhaust gas 91 is higher than a carbon monoxide concentration upper limit value (for example, 11%), the control device 90 estimates that the temperature of the ignition raw-material pellet layer 2 is higher than 1300° C. The control device 90 then controls the opening degrees of the flow-rate adjusting valves V1, V11, based on the oxygen concentration of the exhaust gas 93 detected by the $O_2$ sensor 72, such that the oxygen concentration of the mixed gas 95*a* falls below the predetermined oxygen concentration value, and also controls the operations of the blowers 57, 62 such that the flow rate of the mixed gas 95*a* is constant.

When the carbon monoxide concentration of the exhaust gas 91 is the carbon monoxide lower limit value or higher and is the carbon monoxide concentration upper limit value or lower, the control device 90 estimates that the temperature of the ignition raw-material pellet layer 2 is 1300° C. The control device 90 then controls the opening degrees of the flow-rate adjusting valves V1, V11, based on the oxygen concentration of the exhaust gas 93 detected by the $O_2$ sensor 72, such that the oxygen concentration of the mixed gas 95*a* is adjusted to the predetermined oxygen concentration value, and also controls the operations of the blowers 57, 62 such that the flow rate of the mixed gas 95*a* is constant.

Due to this, it is possible to maintain the combustion temperature of the ignition raw-material pellet layer 2 in the heating region 39*a* at 1300° C. and to stably heat the raw-material pellet bed 4 with the combustion heat generated in the ignition raw-material pellet layer 2.

In the reduction region 39*b* (second to fourth wind boxes 33*b* to 33*d*), in the same way as in the heating region 39*a* (first wind box 33*a*), the control device 90 estimates the combustion state of the raw-material pellet bed 4 heated by the ignition raw-material pellet layer 2 in the reduction region 39*b* (above the second to fourth wind boxes 33*b* to 33*d*) from the carbon monoxide concentration of the exhaust gas 91 flowing through the first to third exhaust ducts 51*a* to 51*c* which is detected by each of the CO sensors 71*b* to 71*d*.

For example, as shown in FIG. 3, when the carbon monoxide concentration of the exhaust gas 91 is lower than 10% which is the carbon monoxide concentration lower limit value, the control device 90 estimates that the temperature of the raw-material pellet bed 4 is lower than 1300° C. The control device 90 then controls the opening degrees of the flow-rate adjusting valves V2 to V4 and V12 to V14, based on the oxygen concentration of the exhaust gas 93 detected by the $O_2$ sensor 72, such that the oxygen concentrations of the mixed gases 95*b* to 95*d* exceed 10% which is the predetermined oxygen concentration value (oxygen concentration required to stably combust the raw-material pellet bed 4 at 1300° C.), and also controls the operations of the blowers 57, 62 such that the flow rates of the mixed gases 95*b* to 95*d* are constant.

When the carbon monoxide concentration of the exhaust gas 91 is higher than 11% which is the carbon monoxide concentration upper limit value, the control device 90 estimates that the temperature of the raw-material pellet bed 4 is higher than 1300° C. The control device 90 then controls the opening degrees of the flow-rate adjusting valves V2 to V4 and V12 to V14, based on the oxygen concentration of the exhaust gas 93 detected by the $O_2$ sensor 72, such that the oxygen concentrations of the mixed gases 95*b* to 95*d* fall below 10% which is the predetermined oxygen concentration value, and also controls the operations of the blowers 57, 62 such that the flow rates of the mixed gases 95*b* to 95*d* are constant.

When the carbon monoxide concentration of the exhaust gas 91 is the carbon monoxide concentration lower limit value or higher and is the carbon monoxide concentration upper limit value or lower (for example is 10% or higher and is 11% or lower), the control device 90 controls the opening degrees of the flow-rate adjusting valves V2 to V4 and V12 to V14, based on the oxygen concentration of the exhaust gas 93 detected by the $O_2$ sensor 72, such that the oxygen concentrations of the mixed gases 95*b* to 95*d* are adjusted to 10% which is the predetermined oxygen concentration value, and also controls the operations of the blowers 57, 62 such that the flow rates of the mixed gases 95*b* to 95*d* are constant.

Accordingly, the temperature of the combustion zone of the raw-material pellet bed 4 can be maintained at 1300° C. in the reduction region 39*b*.

Due to the configuration described above, as shown in part (b) of FIG. 2, the carbon monoxide gas in the mixed gases 95*b* to 95*d* are combined with the carbon monoxide gas generated by the reduction and, as a result, the concentration of the carbon monoxide gas increases to a combustion range of the carbon monoxide gas (12% or higher) around the raw-material pellets 3. Then, about 50% to about 60% of the entire carbon monoxide gas is combusted causing the temperature to rise to a high level, and the combustion zone with a temperature required for the reduction of the partially reduced iron is thereby formed. In other words, carbon monoxide is generated by turning carbon in the reduction carbon material in the raw-material pellets 3 into gas, and the generated carbon monoxide bonds with oxygen in the iron oxide-containing raw material, thereby causing the reduction to proceed. The gas 91 in the reduction region 39*b*, such as the remainder of the carbon monoxide and the flammable volatile component not used for the combustion, flows through the first to third exhaust ducts 51*a* to 51*c* and the exhaust manifold 52, is subjected to removal of solid objects such as dust in the scrubber 54, is subjected to mist removal in the mist separator 56, and is fed to the wind boxes 33*b* to 33*d* via the blower 57, the circulating gas duct 58, and the second to fourth branch circulating gas ducts 59*b* to 59*d*. In the aforementioned reduction region 39*b*, on the grate 101 traveling from a position above the second wind box 33*b* to a position above the fourth wind box 33*d*, the heating of the raw material pellets 3, the generation and combustion of flammable volatile component, the generation of carbon monoxide gas, the combustion of the carbon monoxide gas by the circulation of the remainder of the carbon monoxide gas and the flammable volatile component, and the reduction reaction of iron oxide occurs sequentially from a bottom surface side to an upper layer of the raw-material pellet bed 4, and the combustion zone moves in the height direction of the raw-material pellet bed 4.

Accordingly, since the device for producing partially reduced iron of the embodiment detects the carbon monoxide concentration of the exhaust gas 91 discharged from each of the regions 39*a* to 39*c* of the reduction furnace main body 32, the device for producing partially reduced iron can more surely estimate the reduction state (combustion state) of the ignition raw-material pellets 1 (ignition raw-material pellet layer 2) and the raw-material pellets 3 (raw-material pellet bed 4) which correlates with the carbon monoxide concentration in the exhaust gas 91, even when the ignition raw-material pellets 1 and the raw-material pellets 3 (raw material) vary greatly in the particle size distribution, the water content amount, the composition, and the like and the variation among lots of the ignition raw-material pellets 1 and the raw-material pellets 3 (raw material) is great. Since the mixed gases 95*a*, 95*a* to 95*d*, 95*e* whose oxygen concentrations are adjusted based on this estimation are fed into the reduction furnace main body 32, the temperature of the combustion zone of the ignition raw-material pellet layer 2 and the raw-material pellet bed 4 can be stabilized in the regions 39*a* to 39*c*. Accordingly, unlike the conventional method in which the oxygen concentrations of the respective regions are constant and the conventional method in which the temperature inside the furnace is actually measured, the partially reduced iron 5 with a desired degree of metallization (degree of reduction) can be efficiently produced without insufficient reduction or excessive fusing.

The reduction region 39*b* can be adjusted to be an environment suitable for the reduction processing of the raw-material pellets 3, i.e. the temperature (maximum temperature) of the combustion zone of the raw-material pellet bed 4 can be adjusted to be always around 1300° C. by: detecting the carbon monoxide concentration of the exhaust gas 91 discharged from the reduction region 39*b*; estimating the reduction state (combustion state) of the ignition raw-material pellet layer 2 (ignition raw-material pellets 1) and the raw-material pellet bed 4 (raw-material pellets 3) in the reduction region 39*b* from the detection result; calculating the oxygen concentrations of the mixed gases 95*b* to 95*d* required to stabilize the reduction (combustion) of the ignition raw-material pellet layer 2 and the raw-material pellet bed 4 in the reduction region 39*b*, based on the estimation result; and controlling the opening degrees of the flow-rate adjusting valves V2 to V4 and V12 to V14 and the operations of the blowers 57, 62, based on the oxygen concentration of the exhaust gas detected by the $O_2$ sensor 72, such that the oxygen concentrations of the mixed gases 95*b* to 95*d* are adjusted to the calculation results. As a result, the partially reduced iron 5 whose degree of reduction is stable can be produced.

The ignition region 39*a* can be adjusted to be an environment suitable for the reduction processing of the ignition raw-material pellets 1 and the raw-material pellets 3 by: detecting the carbon monoxide concentration of the exhaust gas 91 discharged from the ignition region 39*a*; estimating the reduction state (combustion state) of the ignition raw-material pellet layer 2 (ignition raw-material pellets 1) and the raw-material pellet bed 4 (raw-material pellets 3) in the ignition region 39*a* from the detection result; calculating the oxygen concentration of the mixed gas 95*a* required to stabilize the reduction (combustion) of the ignition raw-material pellet layer 2 and the raw-material pellet bed 4 in the ignition region 39*a*, based on the estimation result; and controlling the opening degrees of the flow-rate adjusting valves V1, V11 and the operations of the blowers 57, 62, based on the oxygen concentration of the exhaust gas 93 detected by the $O_2$ sensor 72, such that the oxygen concentration of the mixed gas 95*a* is adjusted to the calculation result. As a result, the raw-material pellets 3 can be sufficiently heated by the ignition raw-material pellets 1. Moreover, it is possible to sufficiently generate the flammable volatile component and the flammable gas and efficiently heat the raw-material pellets 3 by the ignition raw-material pellets 1.

The portions above the respective wind boxes 33*a* to 33*d* can be adjusted to be an environment suitable for the reduction processing of the ignition raw-material pellets 1 and the raw-material pellets 3 by: measuring the carbon monoxide concentration of the exhaust gas 91 for each of the wind boxes 33*a* to 33*d*; estimating the reduction state (combustion state) of the ignition raw-material pellet layer 2 (ignition raw-material pellets 1) and the raw-material pellet bed 4 (raw-material pellets 3) in each of the portions above the wind boxes 33*a* to 33*d* from the measurement result; calculating the oxygen concentrations of the mixed gases 95*a* to 95*d* required to stabilize the reduction (combustion) of the ignition raw-material pellet layer 2 and the raw-material pellet bed 4 in the portions above the respective wind boxes 33*a* to 33*d*, based on the estimation result; and controlling the opening degrees of the flow-rate adjusting valves V1 to V4 and V11 to V14 and the operations of the blowers 57, 62, based on the oxygen concentration of the exhaust gas 93 detected by the $O_2$ sensor 72, such that the oxygen concentrations of the mixed gases 95*a* to 95*d* are adjusted to the calculation results. The raw-material pellet bed 4 can be thereby efficiently heated by the ignited ignition raw-material pellet layer 2. The combustion zone can be efficiently formed in the raw-material pellet bed 4. The combustion zone can stably move upward in the raw-material pellet bed 4. Accordingly, the partially reduced iron 5 can be produced with the degree of reduction being more stable. Hence, a load required to improve the degree of reduction in a melting furnace which is the next step can be suppressed.

Other Embodiments

In the aforementioned embodiment, description is given by using the device for producing partially reduced iron including the grate reduction furnace 100 through which the wind passes upward. However, the device for producing partially reduced iron may be configured as follows. The raw-material pellet supplying device and the heating furnace are arranged in this order from upstream in the traveling direction of the grate and the device for producing partially reduced iron includes a grate reduction furnace through which a wind passes downward.

In the aforementioned embodiment, description is given of the device for producing partially reduced iron which adjusts the oxygen concentrations of the mixed gases 95*a* to 95*e* to be fed respectively to the first to fifth wind boxes 33*a* to 33*e*. However, the partially reduced iron producing apparatus may be configured to adjust the oxygen concentrations of the mixed gas 95*a*, the mixed gases 95*b* to 95*d*, and the mixed gas 95*e* respectively for the heating region 39*a*, the reduction region 39*b*, and the cooling region 39*c*.

INDUSTRIAL APPLICABILITY

Since the device for producing partially reduced iron of the present invention can efficiently produce partially reduced iron with a predetermined degree of reduction, the device for producing partially reduced iron can be beneficially used in the steel industry and the like.

EXPLANATION OF THE REFERENCE NUMERALS

1 IGNITION RAW-MATERIAL PELLET
2 IGNITION RAW-MATERIAL PELLET LAYER
3 RAW-MATERIAL PELLET
4 RAW-MATERIAL PELLET BED
5 PARTIALLY REDUCED IRON
10 IGNITION RAW-MATERIAL PELLET SUPPLYING DEVICE

20 HEATING FURNACE
21 COMBUSTION BURNER
22 COMBUSTION GAS EXHAUST DUCT
23 DUST COLLECTOR
30 REDUCTION FURNACE
31 RAW-MATERIAL PELLET SUPPLYING DEVICE (FEED HOPPER)
32 REDUCTION FURNACE MAIN BODY
33*a* to 33*e* FIRST TO FIFTH WIND BOXES
34 HOOD
35 TRACK
36 SUPPORTING FRAME
37 ROLLER
38*a*, 38*b* PARTITION PLATE
39*a* IGNITION REGION (IGNITION RAW-MATERIAL PELLET COMBUSTION REGION)
39*b* REDUCTION REGION (RAW-MATERIAL PELLET HEATING REGION)
39*c* COOLING REGION (RAW-MATERIAL PELLET COOLING REGION)
41, 43 WATER SEAL TROUGH
42, 44 SEAL PLATE
51*a* to 51*c* FIRST TO THIRD EXHAUST DUCTS
52 EXHAUST MANIFOLD
53 IGNITION REGION GAS EXHAUST DUCT
54 SCRUBBER (CLEANING DUST COLLECTING DEVICE)
55 EXHAUST GAS DUCT
56 MIST SEPARATOR
57 BLOWER
58 CIRCULATING GAS DUCT
59*a* to 59*e* FIRST TO FIFTH BRANCH CIRCULATING GAS DUCTS
60 AIR FEEDING DEVICE
61 AIR FEED DUCT
62 BLOWER
63 AIR DUCT
64*a* to 64*e* FIRST TO FIFTH BRANCH AIR DUCTS
71*a* to 71*d* CO SENSOR
72 $O_2$ SENSOR
90 CONTROL DEVICE
100 GRATE REDUCTION FURNACE (DEVICE FOR PRODUCING PARTIALLY REDUCED IRON)
101 GRATE (ENDLESS GRATE)
V1 to V5 FLOW-RATE ADJUSTING VALVE
V11 to V15 FLOW-RATE ADJUSTING VALVE

The invention claimed is:

1. A device for producing partially reduced iron including: a reduction furnace main body in which pellets formed by mixing and pelletizing a reduction carbon material and an iron oxide-containing raw material are packed on an endless grate to be heated and reduced; exhaust gas circulating means for circulating an exhaust gas discharged from a pellet bed by discharging the exhaust gas from the reduction furnace main body and feeding the exhaust gas to the reduction furnace main body; and air feeding means for feeding air to the reduction furnace main body, the device being configured to produce a partially reduced iron by combusting a flammable gas and a volatile component together with the exhaust gas and the air to form a combustion zone in the pellet bed, and causing the combustion zone to move sequentially toward an upper side of the pellet bed along with the movement of the endless grate, the flammable gas generated by the reduction, the volatile component generated when the pellets which are heated heat the pellets in an upper layer, characterized in that the device for producing partially reduced iron comprises:

carbon monoxide concentration detecting means for detecting a carbon monoxide concentration of the exhaust gas discharged from the reduction furnace main body;

oxygen concentration detecting means for detecting an oxygen concentration of the exhaust gas to be fed to the reduction furnace main body;

exhaust gas circulation rate adjusting means for adjusting a circulation rate of the exhaust gas to be fed to the reduction furnace main body by the exhaust gas circulating means;

air feed rate adjusting means for adjusting a feed rate of the air to be fed to the reduction furnace main body by the air feeding means; and control means for controlling the exhaust gas circulation rate adjusting means and the air feed rate adjusting means, the control means controls the exhaust gas circulation rate adjusting means and the air feed rate adjusting means based on the carbon monoxide concentration of the exhaust gas detected by the carbon monoxide concentration detecting means and the oxygen concentration of the exhaust gas detected by the oxygen concentration detecting means.

2. The device for producing partially reduced iron according to claim 1, wherein the reduction furnace main body includes a reduction region in which the combustion zone is formed in the pellet bed and moves sequentially toward the upper side of the pellet bed along with the movement of the endless grate, the carbon monoxide concentration detecting means detects a carbon monoxide concentration of the exhaust gas discharged from the reduction region of the reduction furnace main body, the exhaust gas circulation rate adjusting means adjusts a circulation rate of the exhaust gas to be fed to the reduction region of the reduction furnace main body, and the air feed rate adjusting means adjusts a feed rate of the air to be fed to the reduction region of the reduction furnace main body.

3. The device for producing partially reduced iron according to claim 1, wherein the reduction furnace main body includes an ignition region in which a lower layer of the pellet bed is ignited by the pellets which are ignited, the carbon monoxide concentration detecting means detects a carbon monoxide concentration of the exhaust gas discharged from the ignition region of the reduction furnace main body, the exhaust gas circulation rate adjusting means adjusts a circulation rate of the exhaust gas to be fed to the ignition region of the reduction furnace main body, and the air feed rate adjusting means adjusts a feed rate of the air to be fed to the ignition region of the reduction furnace main body.

4. The device for producing partially reduced iron according to claim 1, wherein when the carbon monoxide concentration of the exhaust gas detected by the carbon monoxide concentration detecting means is lower than a carbon monoxide concentration lower limit value, the control means controls the exhaust gas circulation rate adjusting means and the air feed rate adjusting means and also controls the exhaust gas circulating means and the air feeding means such that a total oxygen concentration of the exhaust gas and the air to be fed to the reduction furnace main body is increased and a flow rate of the exhaust gas and the air to be fed to the reduction furnace main body is constant, and when the carbon monoxide concentration of the exhaust gas detected by the carbon monoxide concentration detecting means is higher than a carbon monoxide concentration upper limit value, the control means controls the exhaust gas circulation rate adjusting means and the air feed rate adjusting means and also controls the exhaust gas circulating means and the air feeding means such that the total oxygen concentration of the exhaust gas and the air to be fed to the reduction furnace main body is decreased and the flow rate of the exhaust gas and the air to be fed to the reduction furnace main body is constant.

5. The device for producing partially reduced iron according to claim 1, wherein the reduction furnace main body includes a hood and a plurality of wind boxes which cover the endless grate from above and below, the hood having portions facing the plurality of wind boxes, respectively, the exhaust gas circulating means discharges the exhaust gas from each of the portions of the hood and feeds the exhaust gas to each of the plurality of wind boxes, the air feeding means feeds the air to each of the plurality of wind boxes, the carbon monoxide detecting means detects a carbon monoxide concentration of the exhaust gas discharged from each of the portions of the hood respectively facing the plurality of wind boxes, and the control means controls the exhaust gas circulation rate adjusting means and the air feed rate adjusting means for each of the plurality of wind boxes, based on the carbon monoxide concentration of the exhaust gas detected by the carbon monoxide detecting means and the oxygen concentration of the exhaust gas detected by the oxygen concentration detecting means.

6. The device for producing partially reduced iron according to claim 2, wherein the reduction furnace main body includes an ignition region in which a lower layer of the pellet bed is ignited by the pellets which are ignited, the carbon monoxide concentration detecting means detects a carbon monoxide concentration of the exhaust gas discharged from the ignition region of the reduction furnace main body, the exhaust gas circulation rate adjusting means adjusts a circulation rate of the exhaust gas to be fed to the ignition region of the reduction furnace main body, and the air feed rate adjusting means adjusts a feed rate of the air to be fed to the ignition region of the reduction furnace main body.

7. The device for producing partially reduced iron according to claim 2, wherein when the carbon monoxide concentration of the exhaust gas detected by the carbon monoxide concentration detecting means is lower than a carbon monoxide concentration lower limit value, the control means controls the exhaust gas circulation rate adjusting means and the air feed rate adjusting means and also controls the exhaust gas circulating means and the air feeding means such that a total oxygen concentration of the exhaust gas and the air to be fed to the reduction furnace main body is increased and a flow rate of the exhaust gas and the air to be fed to the reduction furnace main body is constant, and when the carbon monoxide concentration of the exhaust gas detected by the carbon monoxide concentration detecting means is higher than a carbon monoxide concentration upper limit value, the control means controls the exhaust gas circulation rate adjusting means and the air feed rate adjusting means and also controls the exhaust gas circulating means and the air feeding means such that the total oxygen concentration of the exhaust gas and the air to be fed to the reduction furnace main body is decreased and the flow rate of the exhaust gas and the air to be fed to the reduction furnace main body is constant.

8. The device for producing partially reduced iron according to claim 3, wherein when the carbon monoxide concentration of the exhaust gas detected by the carbon monoxide concentration detecting means is lower than a carbon monoxide concentration lower limit value, the control means controls the exhaust gas circulation rate adjusting means and the air feed rate adjusting means and also controls the exhaust gas circulating means and the air feeding means such that a total oxygen concentration of the exhaust gas and the air to be fed to the reduction furnace main body is increased and a flow rate of the exhaust gas and the air to be fed to the reduction furnace main body is constant, and when the carbon monoxide concentration of the exhaust gas detected by the carbon monoxide concentration detecting means is higher than a carbon monoxide concentration upper limit value, the control means controls the exhaust gas circulation rate adjusting means and the air feed rate adjusting means and also controls the exhaust gas circulating means and the air feeding means such that the total oxygen concentration of the exhaust gas and the air to be fed to the reduction furnace main body is decreased and the flow rate of the exhaust gas and the air to be fed to the reduction furnace main body is constant.

9. The device for producing partially reduced iron according to claim 2, wherein the reduction furnace main body includes a hood and a plurality of wind boxes which cover the endless grate from above and below, the hood having portions lacing the plurality of wind boxes, respectively, the exhaust gas circulating means discharges the exhaust gas from each of the portions of the hood and feeds the exhaust gas to each of the plurality of wind boxes, the air feeding means feeds the air to each of the plurality of wind boxes, the carbon monoxide detecting means detects a carbon monoxide concentration of the exhaust gas discharged from each of the portions of the hood respectively facing the plurality of wind boxes, and the control means controls the exhaust gas circulation rate adjusting means and the air feed rate adjusting means for each of the plurality of wind boxes, based on the carbon monoxide concentration of the exhaust gas detected by the carbon monoxide detecting means and the oxygen concentration of the exhaust gas detected by the oxygen concentration detecting means.

10. The device for producing partially reduced iron according to claim 3, wherein the reduction furnace main body includes a hood and a plurality of wind boxes which cover the endless grate from above and below, the hood having portions lacing the plurality of wind boxes, respectively, the exhaust gas circulating means discharges the exhaust gas from each of the portions of the hood and feeds the exhaust gas to each of the plurality of wind boxes, the air feeding means feeds the air to each of the plurality of wind boxes, the carbon monoxide detecting means detects a carbon monoxide concentration of the exhaust gas discharged from each of the portions of the hood respectively facing the plurality of wind boxes, and the control means controls the exhaust gas circulation rate adjusting means and the air feed rate adjusting means for each of the plurality of wind boxes, based on the carbon monoxide concentration of the exhaust gas detected by the carbon monoxide detecting means and the oxygen concentration of the exhaust gas detected by the oxygen concentration detecting means.

11. The device for producing partially reduced iron according to claim 4, wherein the reduction furnace main body includes a hood and a plurality of wind boxes which cover the endless grate from above and below, the hood having portions facing the plurality of wind boxes, respectively, the exhaust gas circulating means discharges the exhaust gas from each of the portions of the hood and feeds the exhaust gas to each of the plurality of wind boxes, the air feeding means feeds the air to each of the plurality of wind boxes, the carbon monoxide detecting means detects a carbon monoxide concentration of the exhaust gas discharged from each of the portions of the hood respectively facing the plurality of wind boxes, and the control means controls the exhaust gas circulation rate adjusting means and the air feed rate adjusting means for each of the plurality of wind boxes, based on the carbon monoxide concentration of the exhaust gas detected by the carbon monoxide detecting means and the oxygen concentration of the exhaust gas detected by the oxygen concentration detecting means.

* * * * *